US011096529B1

(12) United States Patent
Cotner

(10) Patent No.: US 11,096,529 B1
(45) Date of Patent: Aug. 24, 2021

(54) TOOTHPASTE ROLLING ASSEMBLY

(71) Applicant: Gary Cotner, Jerseyville, IL (US)

(72) Inventor: Gary Cotner, Jerseyville, IL (US)

( * ) Notice: Subject to any disclaimer, the term of this patent is extended or adjusted under 35 U.S.C. 154(b) by 0 days.

(21) Appl. No.: 17/011,423

(22) Filed: Sep. 3, 2020

(51) Int. Cl.
*B65D 35/24* (2006.01)
*A47K 5/18* (2006.01)
*B65D 83/00* (2006.01)

(52) U.S. Cl.
CPC ..... *A47K 5/18* (2013.01); *B65D 83/0055* (2013.01)

(58) Field of Classification Search
CPC ..... A47K 5/18; B65D 35/28; B65D 35/32; B65D 35/34; B65D 83/0055; B65D 35/24
USPC ..... 222/93, 97, 99, 100, 108
See application file for complete search history.

(56) References Cited

U.S. PATENT DOCUMENTS 2,670,875 A * 3/1954 Perlmutter ..... B65D 35/34 222/100
3,920,157 A * 11/1975 Yeung ..... B65D 35/34 222/100
4,570,828 A * 2/1986 Wood ..... B65D 35/34 222/100
5,082,144 A 1/1992 Sundstrom
5,102,014 A * 4/1992 Yanagisawa ..... B65D 35/34 222/100
5,178,301 A 1/1993 McGanty
5,642,839 A * 7/1997 Lee ..... B65D 35/34 222/99
5,685,457 A * 11/1997 Liberatore ..... B65D 35/28 222/100
5,884,812 A 3/1999 Stawowski
8,096,447 B2 * 1/2012 Liberatore ..... B65D 35/32 222/100
8,752,733 B2 * 6/2014 Rosaen ..... B65D 35/32 222/100
10,513,373 B2 * 12/2019 Yang ..... B65D 35/32
2019/0119006 A1 4/2019 Winikoff

FOREIGN PATENT DOCUMENTS

GB 415249 8/1934
GB 603748 6/1948

* cited by examiner

*Primary Examiner* — Charles P. Cheyney

(57) ABSTRACT

A toothpaste rolling assembly for squeezing toothpaste from a tube of toothpaste includes a key that has a slot extending therethrough to receive an end of a toothpaste tube thereby facilitating the toothpaste tube to be wrapped around the key. A gear is positionable around the key and a sleeve is slidable over the key. The sleeve has a slot therein to accommodate the toothpaste tube when the sleeve is slid over the key. The sleeve has a pair of lobes thereon and each of the lobes releasably engages the gear for retaining the sleeve at various points of rotation about the key. In this way the sleeve can be continually rotated on the key for squeezing toothpaste out of the toothpaste tube.

8 Claims, 4 Drawing Sheets

TOOTHPASTE ROLLING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rolling devices and more particularly pertains to a new rolling device for squeezing toothpaste from a tube of toothpaste.

(2) Description of Related Art Including Information Disclosed Under 37 CFR 1.97 and 1.98

The prior art relates to rolling devices including a clip that fastens to a tube of toothpaste for retaining the tube of toothpaste in a rolled configuration. The prior art discloses a locking tube squeezer that includes a stem with a slot that receives a closed end of a tube and a lock that engages the tube when the tube is rolled on the stem. The prior art discloses a tube squeezer that includes a key that is rotatably coupled to a housing such that a tube can be wrapped around the key for squeezing contents from the tube.

BRIEF SUMMARY OF THE INVENTION

An embodiment of the disclosure meets the needs presented above by generally comprising a key that has a slot extending therethrough to receive an end of a toothpaste tube thereby facilitating the toothpaste tube to be wrapped around the key. A gear is positionable around the key and a sleeve is slidable over the key. The sleeve has a slot therein to accommodate the toothpaste tube when the sleeve is slid over the key. The sleeve has a pair of lobes thereon and each of the lobes releasably engages the gear for retaining the sleeve at various points of rotation about the key. In this way the sleeve can be continually rotated on the key for squeezing toothpaste out of the toothpaste tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figures 1, 2:
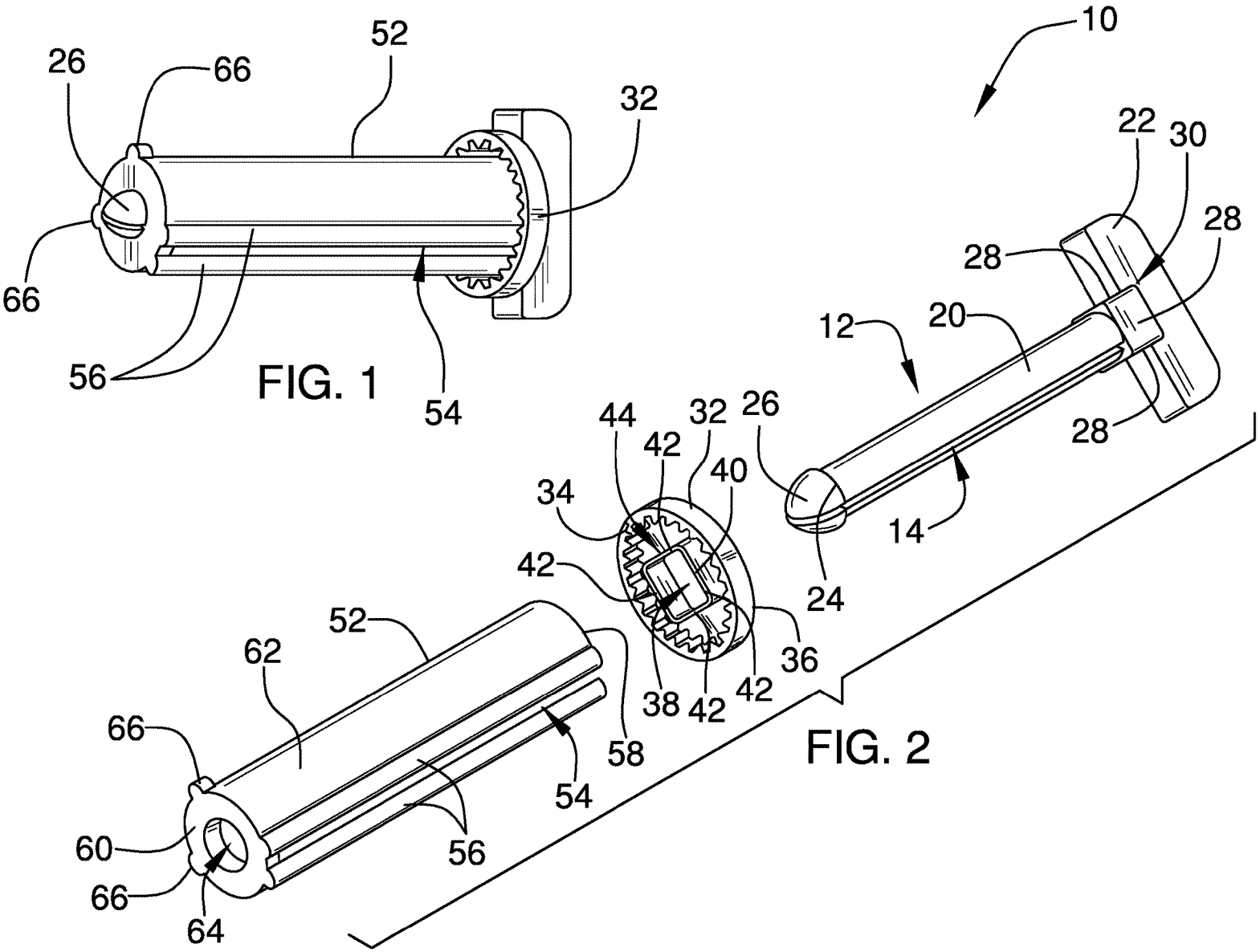
FIG. 1 is a perspective view of a toothpaste rolling assembly according to an embodiment of the disclosure.
FIG. 2 is an exploded perspective view of an embodiment of the disclosure.
Figure 3:
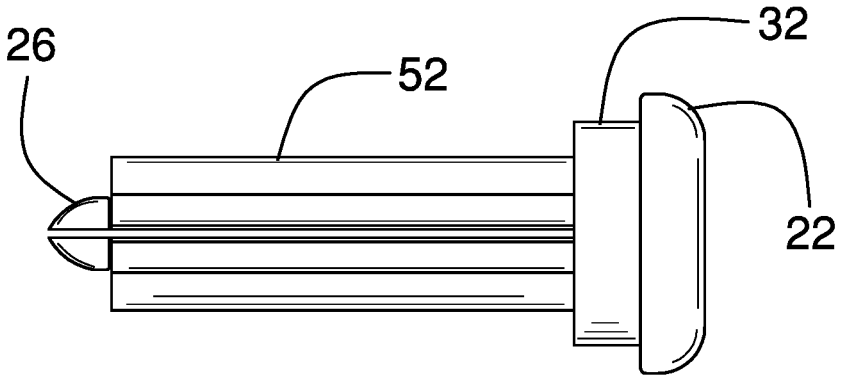
FIG. 3 is a top view of an embodiment of the disclosure.
Figure 4:
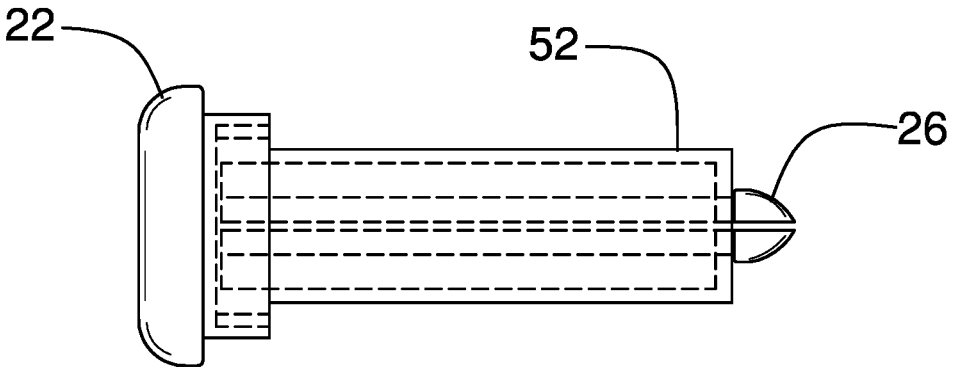
FIG. 4 is a bottom phantom view of an embodiment of the disclosure.
Figure 5:
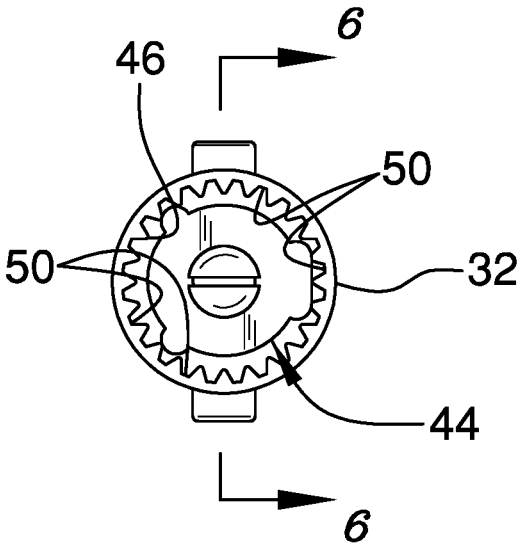
FIG. 5 is a front view of an embodiment of the disclosure.
Figure 6:
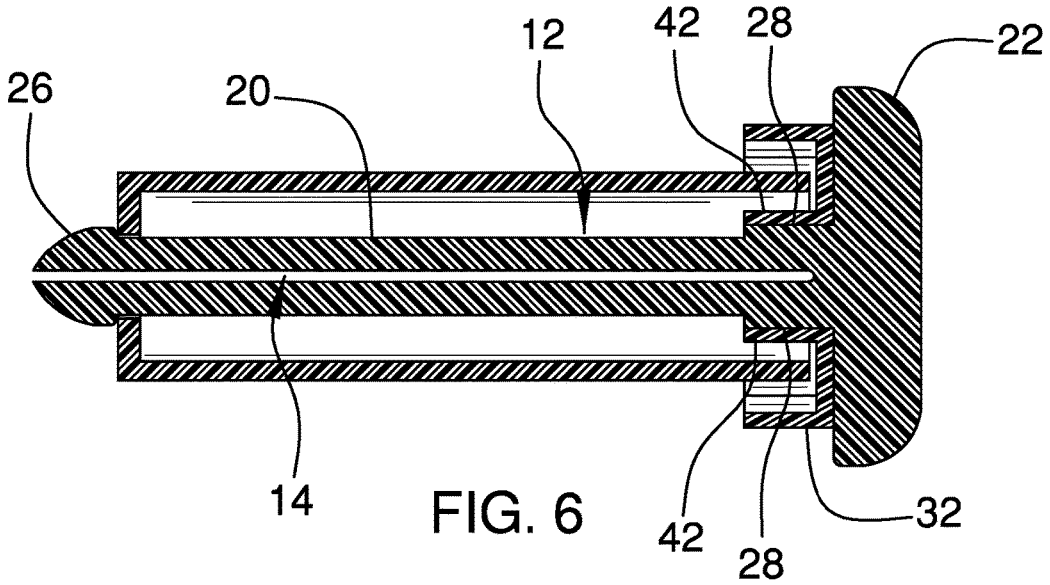
FIG. 6 is a cross sectional view taken along line 6-6 of FIG. 5 of an embodiment of the disclosure.
Figure 7:
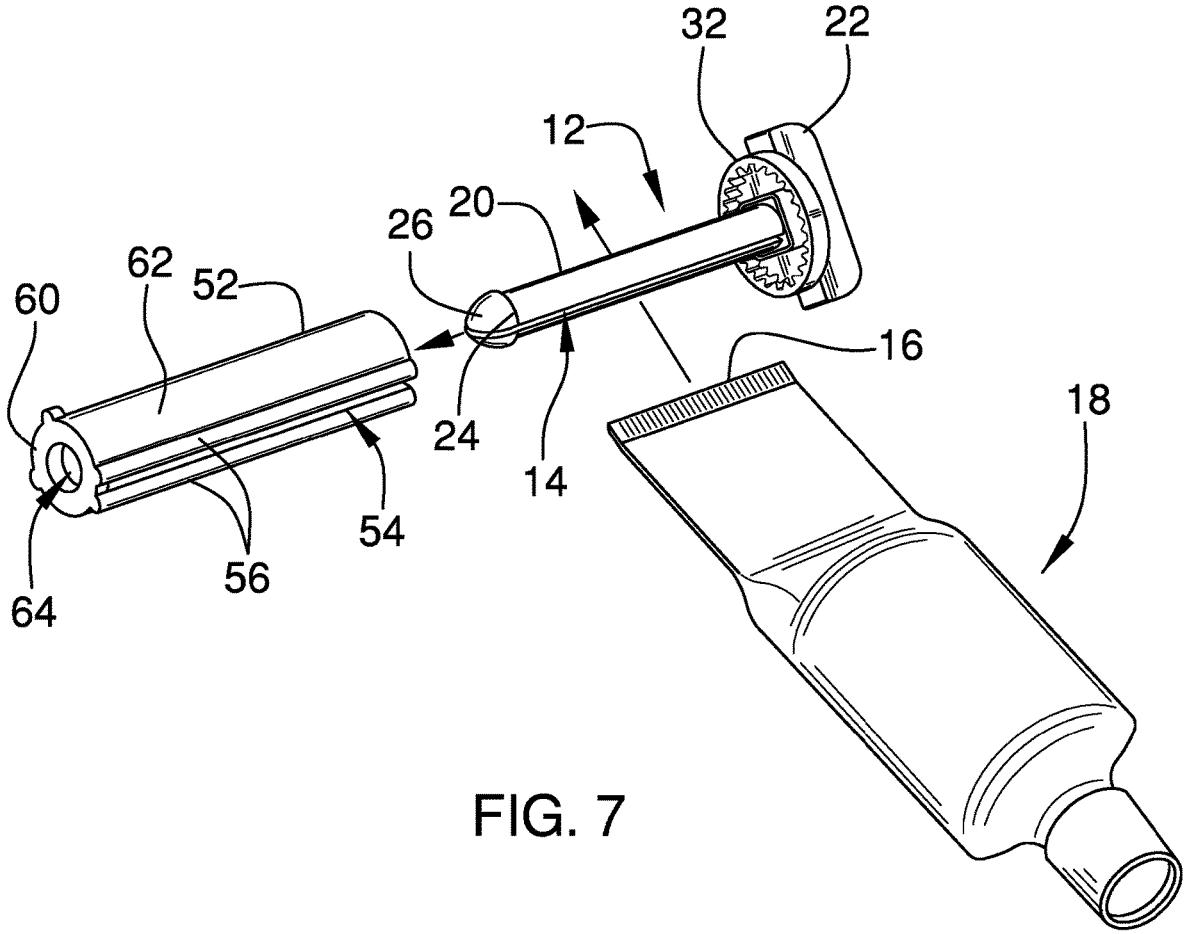
FIG. 7 is a perspective in-use view of an embodiment of the disclosure showing a tube of toothpaste being inserted into a key.
Figure 8:
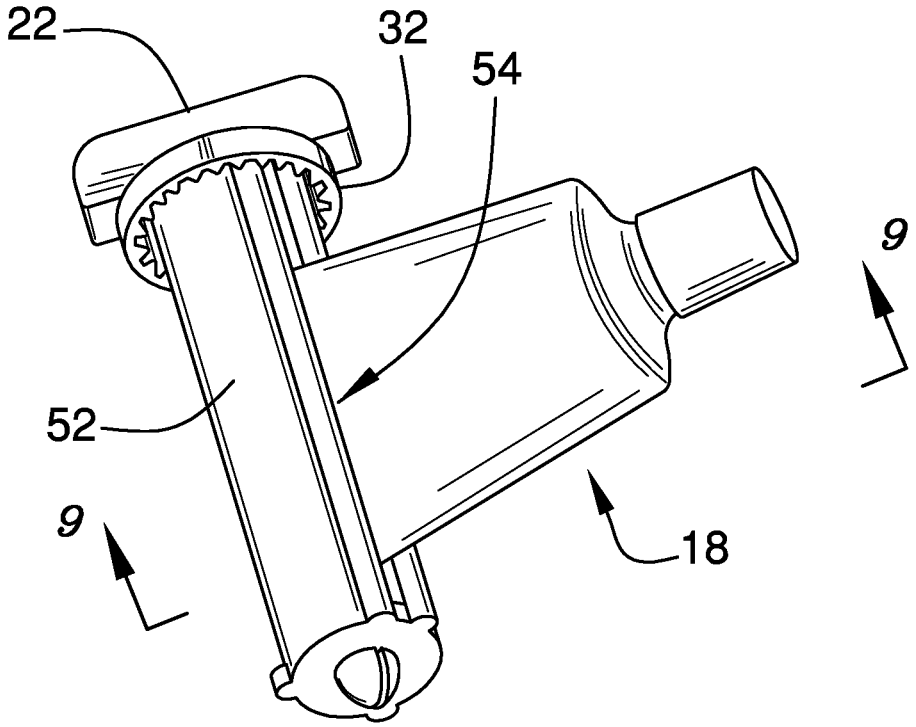
FIG. 8 is a perspective in-use view of an embodiment of the disclosure showing a tube of toothpaste being rolled.
Figure 9:
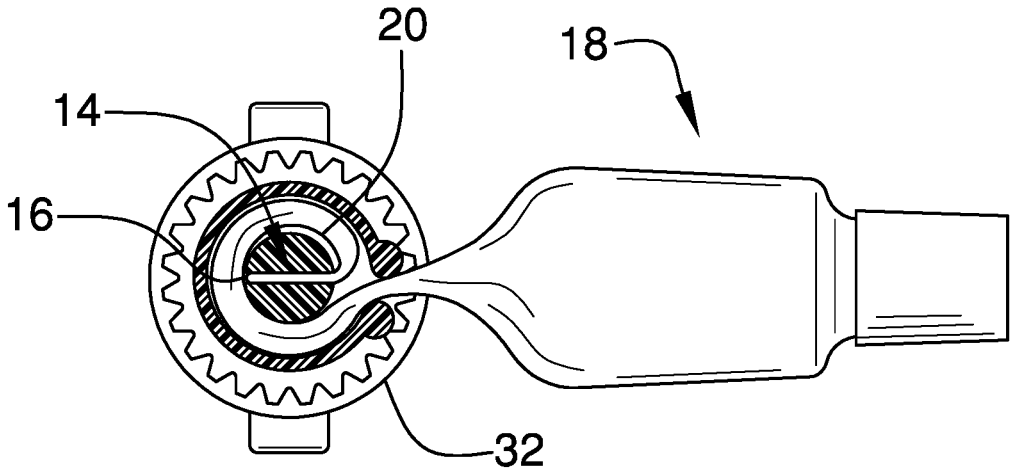
FIG. 9 is a cross sectional view taken along line 9-9 of FIG. 8 of an embodiment of the disclosure.

With reference now to the drawings, and in particular to FIGS. 1 through 9 thereof, a new rolling device embodying the principles and concepts of an embodiment of the disclosure and generally designated by the reference numeral 10 will be described.

As best illustrated in FIGS. 1 through 9, the toothpaste rolling assembly 10 generally comprises a key 12 that has a slot 14 extending therethrough to receive a closed end 16 of a tube of toothpaste 18. In this way the tube of toothpaste 18 can be wrapped around the key 12. The key 12 has a stem 20 and head 22, and the stem 20 has a distal end 24 with respect to the head 22. The distal end 24 has a bulb 26 thereon and the bulb 26 tapers to a blunt point. The slot 14 extends through the stem 20 and the slot 14 extends between the distal end 24 and the head 22. The head 22 has a plurality of intersecting sides 28 located at an intersection 30 between the head 22 and the stem 20 such that the intersection 30 has a rectangular cross section taken along a line extending through the head 22 and the distal end 24 of the stem 20.

A gear 32 is provided and the gear 32 is positionable around the key 12. The gear 32 has a first surface 34 and a second surface 36, and the gear 32 has an opening 38 extending through the first surface 34 and the second surface 36. The opening 38 insertably receives the stem 20 and the opening 38 has a bounding edge 40 which has a plurality of intersecting sides 42 such that the opening has a rectangular shape. Moreover, the opening 38 conforms to the intersection 30 between the stem 20 and the head 22 on the key 12 such that the gear 32 is rotated when the key 12 is rotated. The first surface 34 has a recess 44 therein and the recess 44 has a bounding edge 46 that is spaced from and is coextensive with an outer surface 48 of the gear 32. The bounding edge 46 of the recess 44 has a plurality of depressions 50 therein. The depressions 50 are spaced apart from each other and are distributed around a full circumference of the bounding edge 46 of the recess 44.

A sleeve 52 is provided and the sleeve 52 is slidable over the key 12. The sleeve 52 has a slot 54 therein to accommodate the tube of toothpaste 18 when the sleeve 52 is slid over the key 12. The sleeve 52 has a pair of lobes 56 thereon and each of the lobes 56 releasably engages the gear 32 for retaining the sleeve 52 at various points of rotation about the key 12. In this way the sleeve 52 can be continually rotated on the key 12 to roll the tube of toothpaste 18 around the stem 20 of the key 12 for squeezing toothpaste out of the tube of toothpaste 18.

The sleeve 52 has a first end 58, a second end 60 and an outer wall 62 extending therebetween. The first end 58 is open and the second end 60 has a hole 64 extending therethrough. The slot 54 in the sleeve 52 extends through the outer wall 62 and the slot 54 in the sleeve 52 extends from the first end 58 toward the second end 60. Each of the lobes 56 extends outwardly from the outer wall 62 and each of the lobes 56 extends between the first end 58 and the second end 60. Additionally, each of the lobes 56 is aligned with opposite sides of the slot 54 in the sleeve 52.

The stem 20 of the key 12 is extendable through the sleeve 52 having the bulb 26 on the distal end 24 of the stem 20 extending outwardly through the hole 64 in the second end 60. The bulb 26 has a diameter that is greater than a diameter of the hole 64 to inhibit the bulb 26 from being removed from the hole 64. The bulb 26 is squeezable to compress the slot 14 in the key 12 to facilitate the bulb 26 to be removed from the hole 64. Each of the lobes 56 engages a respective one of the depressions 50 in the bounding edge 46 of the recess 44 in the gear 32 for releasably retaining the sleeve 52 at a selected angle of rotation about the stem 20. A pair of tabs 66 each extends outwardly from the outer wall 62 of the sleeve 52 and each of the tabs 66 is aligned with the second end 60 of the sleeve 52 for gripping and rotating the sleeve 52.

In use, the gear 32 is slid onto the stem 20 of the key 12 and the closed end 16 of the tube of toothpaste 18 is inserted into the slot in the key 12. The sleeve 52 is slid onto the key 12 until the lobes 56 engage the gear 32. The sleeve 52 is subsequently rotated on the key 12 to roll the tube of toothpaste 18 and squeeze toothpaste out of the tube of toothpaste 18. In this way all of the toothpaste can be squeezed from the tube of toothpaste 18 to reduce waste. Additionally, the lobes 56 engage the gear 32 as the sleeve 52 is rotated to inhibit the tube of toothpaste 18 from unrolling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toothpaste rolling assembly for rolling up a toothpaste tube for removing all of the contents of the toothpaste tube, said assembly comprising:

a key having a slot extending therethrough wherein said slot is configured to receive an end of a toothpaste tube thereby facilitating the toothpaste tube to be wrapped around said key;

a gear being positionable around said key;

a sleeve being slidable over said key, said sleeve having a slot therein wherein said slot in said sleeve is configured to accommodate the toothpaste tube when said sleeve is slid over said key, said sleeve having a pair of lobes thereon, each of said lobes releasably engaging said gear for retaining said sleeve at various points of rotation about said key wherein said sleeve is configured to be continually rotated on said key for squeezing toothpaste out of the toothpaste tube;

wherein said sleeve has a first end, a second end and an outer wall extending therebetween, said first end being open, said second end having a hole extending therethrough, said slot in said sleeve extending through said outer wall, said slot in said sleeve extending from said first end toward said second end;

said key having a stem and a head, said stem having a distal end with respect to said head, said distal end having a bulb thereon, said bulb tapering to a blunt point; and each of said lobes extending outwardly from said outer wall, each of said lobes extending between said first end and said second end, each of said lobes being aligned with opposite sides of said slot in said sleeve, said stem of said key being extendable through said sleeve having said bulb on said distal end of said stem extending outwardly through said hole in said second end.

2. The assembly according to claim 1, wherein said key has a stem and a head, said stem having a distal end with respect to said head, said distal end having a bulb thereon, said bulb tapering to a blunt point, said slot extending through said stem, said slot extending between said distal end and said head.

3. The assembly according to claim 2, wherein said head has a plurality of intersecting sides located at an intersection between said head and said stem such that said intersection has a rectangular cross section taken along a line extending through said head and said distal end of said stem.

4. The assembly according to claim 3, wherein said gear has a first surface and a second surface, said gear having an opening extending through said first surface and said second surface, said opening insertably receiving said stem, said opening having a bounding edge having a plurality of intersecting sides such that said opening has a rectangular shape, said opening conforming to said intersection between said stem and said head on said key such that said gear is rotated when said key is rotated.

5. The assembly according to claim 4, wherein said first surface has a recess therein, said recess having a bounding edge being spaced from and being coextensive with an outer surface of said gear, said bounding edge having a plurality of depressions therein, said depressions being spaced apart from each other and being distributed around a full circumference of said bounding edge.

6. The assembly according to claim 1, wherein said bulb has a diameter being greater than a diameter of said hole to inhibit said bulb from being removed from said hole, said bulb being squeezable to compress said slot in said key to facilitate said bulb to be removed from said hole.

7. The assembly according to claim 1, wherein:

said gear has a first surface, said first surface has a recess therein, said recess having a bounding edge being spaced from and being coextensive with an outer surface of said gear, said bounding edge having a plurality of depressions therein, said depressions being spaced apart from each other and being distributed around a full circumference of said bounding edge; and each of said lobes engages a respective one of said depressions in said bounding edge of said recess in said gear for releasably retaining said sleeve at a selected angle of rotation about said stem.

8. A toothpaste rolling assembly for rolling up a toothpaste tube for removing all of the contents of the toothpaste tube, said assembly comprising:

a key having a slot extending therethrough wherein said slot is configured to receive an end of a toothpaste tube thereby facilitating the toothpaste tube to be wrapped around said key, said key having a stem and head, said stem having a distal end with respect to said head, said distal end having a bulb thereon, said bulb tapering to a blunt point, said slot extending through said stem, said slot extending between said distal end and said head, said head having a plurality of intersecting sides located at an intersection between said head and said stem such that said intersection has a rectangular cross section taken along a line extending through said head and said distal end of said stem;

a gear being positionable around said key, said gear having a first surface and a second surface, said gear having an opening extending through said first surface and said second surface, said opening insertably receiving said stem, said opening having a bounding edge having a plurality of intersecting sides such that said opening has a rectangular shape, said opening conforming to said intersection between said stem and said head on said key such that said gear is rotated when said key is rotated, said first surface having a recess therein, said recess having a bounding edge being spaced from and being coextensive with an outer surface of said gear, said bounding edge having a plurality of depressions therein, said depressions being spaced apart from each other and being distributed around a full circumference of said bounding edge; and a sleeve being slidable over said key, said sleeve having a slot therein wherein said slot in said sleeve is configured to accommodate the toothpaste tube when said sleeve is slid over said key, said sleeve having a pair of lobes thereon, each of said lobes releasably engaging said gear for retaining said sleeve at various points of rotation about said key wherein said sleeve is configured to be continually rotated on said key for squeezing toothpaste out of the toothpaste tube, said sleeve having a first end, a second end and an outer wall extending therebetween, said first end being open, said second end having a hole extending therethrough, said slot in said sleeve extending through said outer wall, said slot in said sleeve extending from said first end toward said second end, each of said lobes extending outwardly from said outer wall, each of said lobes extending between said first end and said second end, each of said lobes being aligned with opposite sides of said slot in said sleeve, said stem of said key being extendable through said sleeve having said bulb on said distal end of said stem extending outwardly through said hole in said second end, said bulb having a diameter being greater than a diameter of said hole to inhibit said bulb from being removed from said hole, said bulb being squeezable to compress said slot in said key to facilitate said bulb to be removed from said hole, each of said lobes engaging a respective one of said depressions in said bounding edge of said recess in said gear for releasably retaining said sleeve at a selected angle of rotation about said stem.

* * * * *